United States Patent [19]

Cozzini et al.

[11] Patent Number: 5,046,385

[45] Date of Patent: Sep. 10, 1991

[54] CUTTING EDGE STRAIGHTENING, ALIGNING AND SHARPENING DEVICE

[75] Inventors: Ivo Cozzini, Lincolnwood; George T. Bowers, Evanston, both of Ill.; Alvin G. Rohrbaugh, Ft. Wayne, Ind.

[73] Assignee: Cozzini, Inc, Chicago, Ill.

[21] Appl. No.: 646,682

[22] Filed: Jan. 25, 1991

[51] Int. Cl.[5] ..... B21K 5/12

[52] U.S. Cl. ..... 76/89.2; 76/86; 51/181 R; 51/214

[58] Field of Search ..... 76/82, 86, 89.2, 88, 76/84; 51/214, 181 R, 211, 212

[56] References Cited

U.S. PATENT DOCUMENTS

| | | | |
|---|---|---|---|
| 2,948,167 | 8/1960 | Spano | 51/212 |
| 3,942,394 | 3/1976 | Juranitch . | |
| 4,934,110 | 6/1990 | Juranitch . | |

FOREIGN PATENT DOCUMENTS

| | | | |
|---|---|---|---|
| 622608 | 6/1961 | Canada | 51/214 |
| 39134 | 8/1928 | Denmark | 76/86 |
| 131114 | 5/1902 | Fed. Rep. of Germany | 51/212 |
| 554610 | 3/1923 | France | 76/89.2 |
| 358084 | 9/1931 | United Kingdom | 76/89.2 |

*Primary Examiner*—Roscoe V. Parker

*Attorney, Agent, or Firm*—Lee, Mann, Smith, McWilliams & Sweeney

[57] ABSTRACT

A device for straightening, aligning and sharpening a cutting edge. The device is composed of a base member with an elongated slot transverse to the longitudinal axis of the base member to permit passage of a cutting blade therethrough; a pair of edge sharpening members each secured in the base member and each defining an arcuate sharpening surface extending into the slot and each laterally displaced from each other on the longitudinal axis; and an edge straightener extending outwardly from the base member along the longitudinal central axis.

11 Claims, 1 Drawing Sheet

CUTTING EDGE STRAIGHTENING, ALIGNING AND SHARPENING DEVICE

BACKGROUND OF THE INVENTION

A cutting edge straightening, aligning and sharpening device is used to restore a sharp cutting edge on a blade which has dulled. From time to time, it becomes necessary to straighten, realign and sharpen the microscopic edge of a cutting tool such as a knife. It is important to maintain a uniform pressure and a proper even edge angle when sharpening a cutting edge. Previous sharpening devices have involved complex implements which commonly remove material from the cutting edge. Additionally, many of the previous devices are designed for use either by a right handed or left handed person while sharpening one side of the edge at a time, not both.

SUMMARY OF THE INVENTION

The present invention is an edge straightening, aligning and sharpening device which can be hand-held or bench-mounted and is totally ambidextrous. The preferred embodiment includes a handle, a base member and an edge straightener. The base member includes a pair of ball bearings, laterally offset, each having an arcuate surface extending into a slot formed transverse to the longitudinal axis of the base member. The balls are fixed in place and define a V-shaped notch through which the knife blade is passed to align and sharpen both sides of the cutting edge thereof simultaneously.

DETAILED DESCRIPTION OF THE PREFERRED EMBODIMENT

Figure 1:
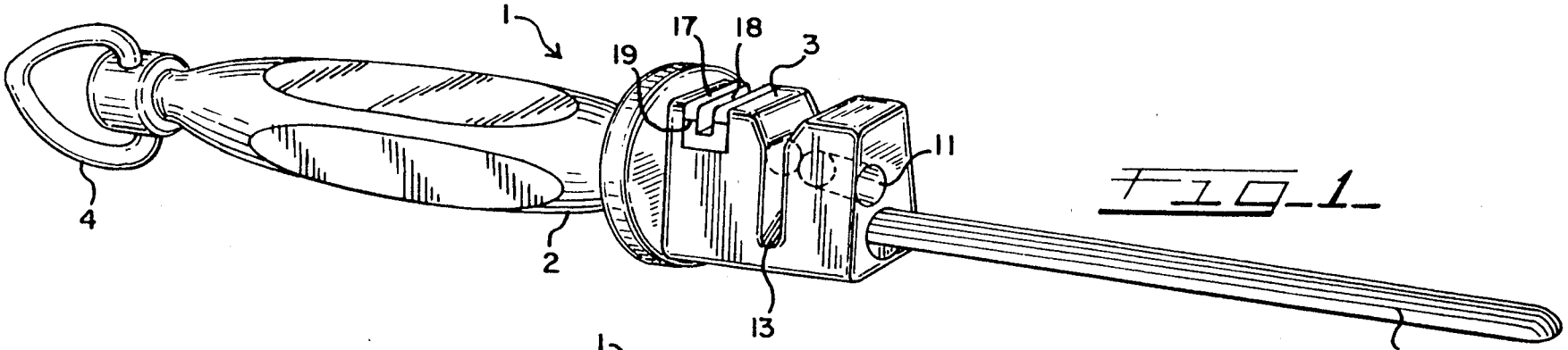
FIG. 1 is a perspective view of the sharpening device.
Figure 2:
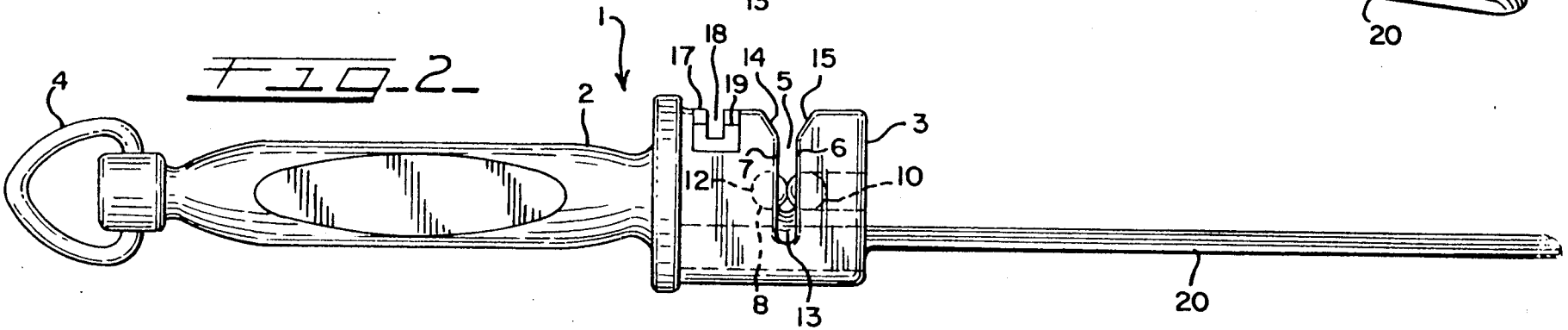
FIG. 2 is a side view of the sharpening device.
Figure 4:
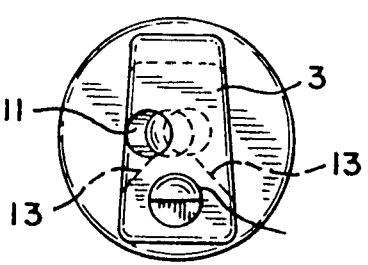
FIG. 4 is an end view of the sharpening device.

Consistent straightening, realignment and sharpening of a cutting edge provides for a more productive cutting tool. A device for straightening, realigning and sharpening cutting edges is illustrated in the drawings and generally designated with the number 1. The device 1 includes a handle 2 for securely grasping the device. The handle 2 is formed integrally with a base member 3. The handle 2 and base member 3 are, preferably, made of plastic, but can be of any other suitable material, for example, metal or wood. At the opposite end of the handle 2 from the base member 3 is a ring 4 providing for easy hanging or storage of the device.

Situated within the base member 3 is a slot 5 preferably oriented substantially perpendicular to the longitudinal central axis of the base member 3. The slot 5 is defined by a first wall 6 and a second wall 7 on opposite sides thereof. This allows for the passage of a knife blade therethrough.

Figure 3:
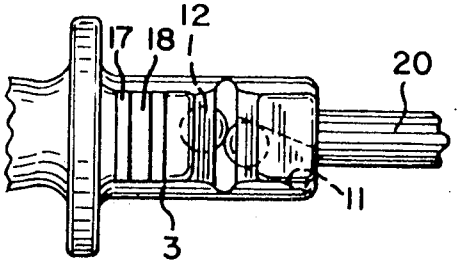
FIG. 3 is a top partial view of the sharpening device.

A pair of edge sharpening members shown as balls 8 and 10 are fixedly mounted in the base member 3 on opposite sides of the slot 5. The edge sharpening members are positioned in the base member 3 through a plug hole 11, as best seen in FIGS. 1 and 3, which is drilled, preferably, at a 20° angle to the central longitudinal axis of the device. The edge sharpening members 8 and 10 are press fit into place. The first edge sharpening member 8 lies fixed within a pocket 12 formed in the left portion of the base member 3 and has an arcuate surface extending from the second wall 7 into the slot 5. The second edge sharpening member 10 is fixed in place within hole 11 and has an arcuate surface extending from the first wall 6 into the slot 5. The first and second edge sharpening members 8 and 10 engage each other within the slot 5 to define a V-shaped groove through which a cutting edge is designed to pass. The angular offset of 20° will provide for simultaneously sharpening both sides of a bevel on the cutting edge up to and including a 40° included angle. The preferable included angle bevel of a knife edge lies within the range of 20°–40°. Changing the angular offset of the edge sharpening members 8 and 10 will change the desired included angle edge bevel on the knife.

The edge sharpening members 8 and 10 are preferably hardened ball bearings made from a polished steel, but could also be of any number of other hardened materials. Different surface finishes of the edge sharpening members 8 and 10 can be used to provide different finishes on a cutting edge, as desired. The smooth, polished finish on the balls produces a fine finish on the sharpened cutting edge. The rougher the finish of the edge sharpening members 8 and 10, the coarser the finish will be on the sharpened cutting edge.

The slot 5 should have at least one tapered slope 13, best seen in FIG. 1, extending outwardly and downwardly from the bottom wall of the slot 5 to an outer wall of the base member to facilitate cleaning and which allows for clearance to protect against contact between the point end of the cutting edge being sharpened and the base member 3. It has been found that any such inadvertent edge contact has the effect of dulling the edge on the point end which has just been sharpened. Also, the walls 6 and 7 can define tapered surfaces 14 and 15 at their upper ends so as to easily guide the blade into the slot 5.

To properly pass between the edge sharpening members 8 and 10, the thickness of the knife blade at the cutting edge should be, preferably, 0.018" or less, at a depth of 1/16 to ⅛ of an inch from the edge of the blade. The blade thickness can be measured using a gauge 17 located on the base member 3. The blade edge is placed into a gauge slot 18 located in the center of the gauge 17 and perpendicular thereto. The cutting edge must slide into the gauge slot 18 to at least the depth of a gauge depth mark 19 located on the front of the gauge 17. If the knife blade is too thick or heavy to enter the gauge slot 18 to the prescribed depth, the blade should be ground or thinned to use the disclosed device 1 properly.

An edge straightener 20 preferably extends from the base member 3 parallel to the central longitudinal axis thereof. This edge straightener 20 should be used prior to edge sharpening to straighten out any rolled, curled or turned cutting edges of the knife or tool being sharpened. The edge straightener 20 is formed having a radius on the top portion and a flat surface on the bottom, and is composed of a high carbon case hardened steel with longitudinally extending lines of conventional design as commonly used for a butcher steel. The half round configuration of the edge straightener 20 discourages improper use of the edge straightener 20 as simply a conventional butcher steel.

In operation, the sharpening device can be bench mounted or can be held in one hand while the cutting tool to be sharpened is held in the opposite hand. The knife blade is laid flat across the edge straightener 20 and the cutting edge of the knife is drawn across the grooves of the edge straightener 20 with the back edge of the knife leading the stroke motion and raised slightly so as to engage the rolled cutting edge with the grooves of the edge straightener 20. This is a reverse sharpening stroke. The reverse stroke allows for any rolled, curled or turned portions of the cutting edge to be straightened. This procedure is followed on both sides of the blade until the reverse stroke feels smooth. The cutting edge is then drawn through the slot 5 along the full length of the cutting edge, from the heel of the blade to the point end while passing through the V formed by the edge sharpening members 8 and 10. This results in simultaneously creating a uniform included angle bevel on the cutting edge of up to 40°. The sharpening device is constructed to consistently produce a uniform predetermined sharpening result regardless of the sharpening skill, or lack thereof, of the operator or user of the device.

The present invention provides a sharpening device which restores the cutting edge by applying a uniform pressure and angle to the cutting edge to be sharpened regardless of the care used by the operator. The sharpening device provides for the straightening, realignment and restoration of the dull cutting edge instead of removal of material from the cutting edge, thereby increasing the useful life of the knife or cutting tool. Additionally, the device is manufactured as a totally ambidextrous unit which can be hand held or bench mounted and sharpens both sides of the cutting edge simultaneously.

Various features of the invention have been particularly shown and described in connection with the illustrated embodiment of the invention, however, it must be understood that these particular arrangements merely illustrate and the invention is to be given its fullest interpretation within the terms of the appended claims and reasonable equivalents thereof.

What is claimed is:

1. A cutting edge sharpening device including a base member having a longitudinally extending central axis; a slot defined in said base member and transverse to the central axis thereof to allow passage of a cutting blade therethrough, said slot defining first and second walls on opposite sides thereof; and first and second edge sharpening members each mounted in said base member on opposite sides of said slot, said first edge sharpening member having a surface extending into said slot and said second edge sharpening member having a surface extending into said slot, said first and second edge sharpening members defining therebetween a V-shaped groove through which the cutting edge is designed to pass and at least one tapered slope defined in said base member, said slope extending outwardly and downwardly from a bottom wall of said slot to an outer wall of said base member to protect against contact between a point of a cutting edge and said base member.

2. A cutting edge sharpening device as in claim 1 wherein said first and second edge sharpening members are balls fixedly mounted within said base member and secured against rotation.

3. A cutting edge sharpening device as in claim 1 wherein said first and second edge sharpening members are laterally displaced from each other and are aligned at a predetermined angle to the longitudinally extending central axis.

4. A cutting edge sharpening device as in claim 1 including an edge straightener extending from said base member parallel to the central longitudinal axis thereof.

5. A cutting edge sharpening device as in claim 1 wherein at least one of said first wall or said second wall defines an outwardly tapered surface at its upper end so as to guide the edge to be sharpened into said slot.

6. A cutting edge sharpening device as in claim 1 including a centrally disposed handle connected to said base member and extending longitudinally rearwardly therefrom.

7. A cutting edge sharpening device as in claim 3 wherein said first and second edge sharpening members are aligned at an angle of approximately 20° to the longitudinally extending central axis.

8. A cutting edge sharpening device as in claim 1 in which said first and second edge sharpening members are positioned in intimate contact with each other.

9. A cutting edge sharpening device as in claim 1 wherein said surface of at least one of said edge sharpening members extending into said slot includes an arcuate surface.

10. A cutting edge sharpening device as in claim 1 in which said first edge sharpening member and said second edge sharpening member each include an arcuate surface extending into said slot.

11. A cutting edge sharpening device as in claim 1 additionally including a means for measuring the thickness of a cutting edge.

* * * * *